United States Patent [19]

Steiner

[11] Patent Number: 4,592,393

[45] Date of Patent: Jun. 3, 1986

[54] WEFT THREAD PREPARATION DEVICE

[75] Inventor: Alois Steiner, Rieden, Switzerland

[73] Assignee: Sulzer Brothers Limited, Winterthur, Switzerland

[21] Appl. No.: 675,237

[22] Filed: Nov. 27, 1984

[30] Foreign Application Priority Data

Dec. 1, 1983 [EP] European Pat. Off. ..... 83112065.4

[51] Int. Cl.[4] ..... D03D 41/00; D03D 47/36

[52] U.S. Cl. ..... 139/11; 139/28; 139/452

[58] Field of Search ..... 139/1 R, 11 R, 11 A, 139/429, 452, 453, 28

[56] References Cited

U.S. PATENT DOCUMENTS

| | | | |
|---|---|---|---|
| 4,129,153 | 12/1978 | Bonetti | 139/11 A |
| 4,425,946 | 1/1984 | McGinley | 139/11 A |
| 4,492,254 | 1/1985 | Steiner | 139/11 A |

*Primary Examiner*—Henry Jaudon
*Attorney, Agent, or Firm*—Kenyon & Kenyon

[57] ABSTRACT

The weft-preparation device for superposed shed type weaving machines comprises a weft measuring drums, a weft-severing device with a plurality of shears and a weft insertion device. Each shear comprises a blowing tube which conveys a weft yarn. The insertion or picking device has a guide duct for the weft which is open on one side and which is closable by a closure member. The severing device places before the guide duct entry whichever shear is guiding a weft for severance. The duct is then closed. When a weft has been fully picked in a picking comb, it is severed. The weft then remaining is conveyed by the blowing tube by way of the picking device into the next picking comb which has meanwhile entered. The severing device is then lowered one step at a time and the subsequent wefts are severed and picked.

6 Claims, 6 Drawing Figures

WEFT THREAD PREPARATION DEVICE

This invention relates to a weft thread preparation device. More particularly, this invention relates to a weft thread preparation device for a superposed shed type weaving machine.

Heretofore, various types of weaving machines have been known. In more recent times, a weaving machine of the superposed shed type has been proposed wherein use is made of a weaving rotor for the picking of weft threads into a shed of warp threads. In such cases, for example, as described in Swiss Pat. No. 543,622, weft thread preparation devices have been provided for the picking of the weft threads. Such devices have generally included at least one drum for continuously measuring and conveying weft threads which are taken up from stationary supply bobbins, shears for cutting the picked weft threads and a weft insertion device for conveying the weft threads into picking combs on the weaving rotor. However, such devices have been relatively complicated and require high initial costs.

Accordingly, it is an object of the invention to provide a weft thread preparation device of simple low cost construction.

It is another object of the invention to provide a weft yarn and preparation device which is capable of picking a multiplicity of weft yarns on a continuous basis.

Briefly, the invention provides a weft thread preparation device for a superposed shed type weaving machine which employs a weaving rotor with a plurality of weft picking combs and beating-up combs. In accordance with the invention, the device includes a weft measuring means, a severing means, a weft insertion means and suitable control means for effecting the operations of the severing means and weft insertion means.

The weft measuring means is constructed for continuously measuring and conveying a plurality of weft threads.

The severing means is constructed with a plurality of shears for severing the respective weft threads. Further, each shear has a blowing tube for receiving a weft-conveying air stream to pneumatically convey a weft thread therethrough as well as a cutting element for severing a weft thread extending from the blowing tube.

The weft insertion means has a guide duct extending from a selected one of the shears to the weaving rotor in order to guide a weft thread therethrough. In addition, the weft insertion means has a closure member on one side of the guide duct in order to retain a weft thread therein.

One control means is provided for selectively moving the shears in program sequence in order to position a blowing tube of a respective shear in alignment with the guide duct to convey a weft thread thereto. A second control means is provided for moving the closure member from the guide duct in response to insertion of a weft thread into a picking comb adjacent the guide duct. This permits a subsequent lateral movement of the weft thread from the guide duct as the rotor continues to rotate. A third control means is also provided for selectively actuating the shears in program sequence in order to sever a weft thread therein in response to picking of the weft thread across a picking comb.

The operation of the weft thread preparation device is such that a series of weft threads can be continuously picked without interruption of the operation of the device or weaving rotor.

These and other objects and advantages of the invention will become more apparent from the following detailed description taken in conjunction with the accompanying drawings wherein.

Figure 5A:
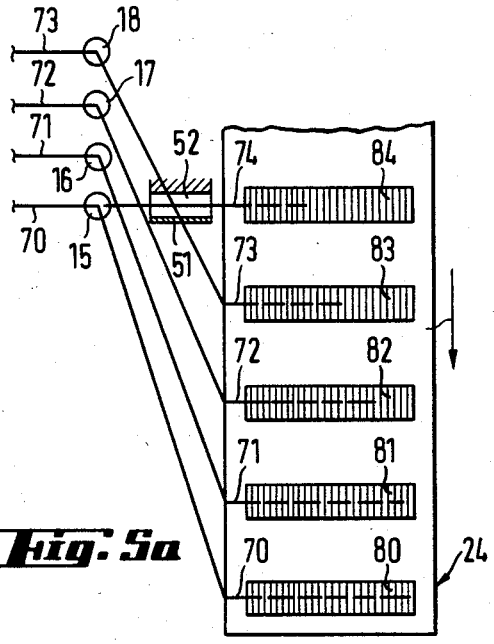
Figure 5B:
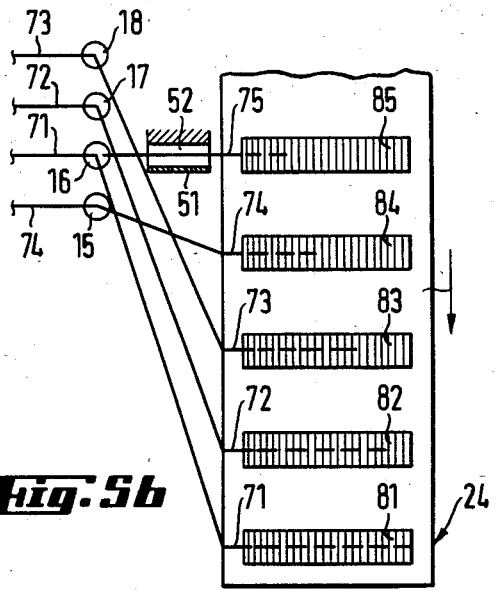

FIG. 5*a* diagramatically illustrates a weaving rotor and the weft thread preparation device in one stage of operation; and FIG. 5*b* diagramatically illustrates the weaving rotor and preparation device in a further step of operation.

Figure 1:
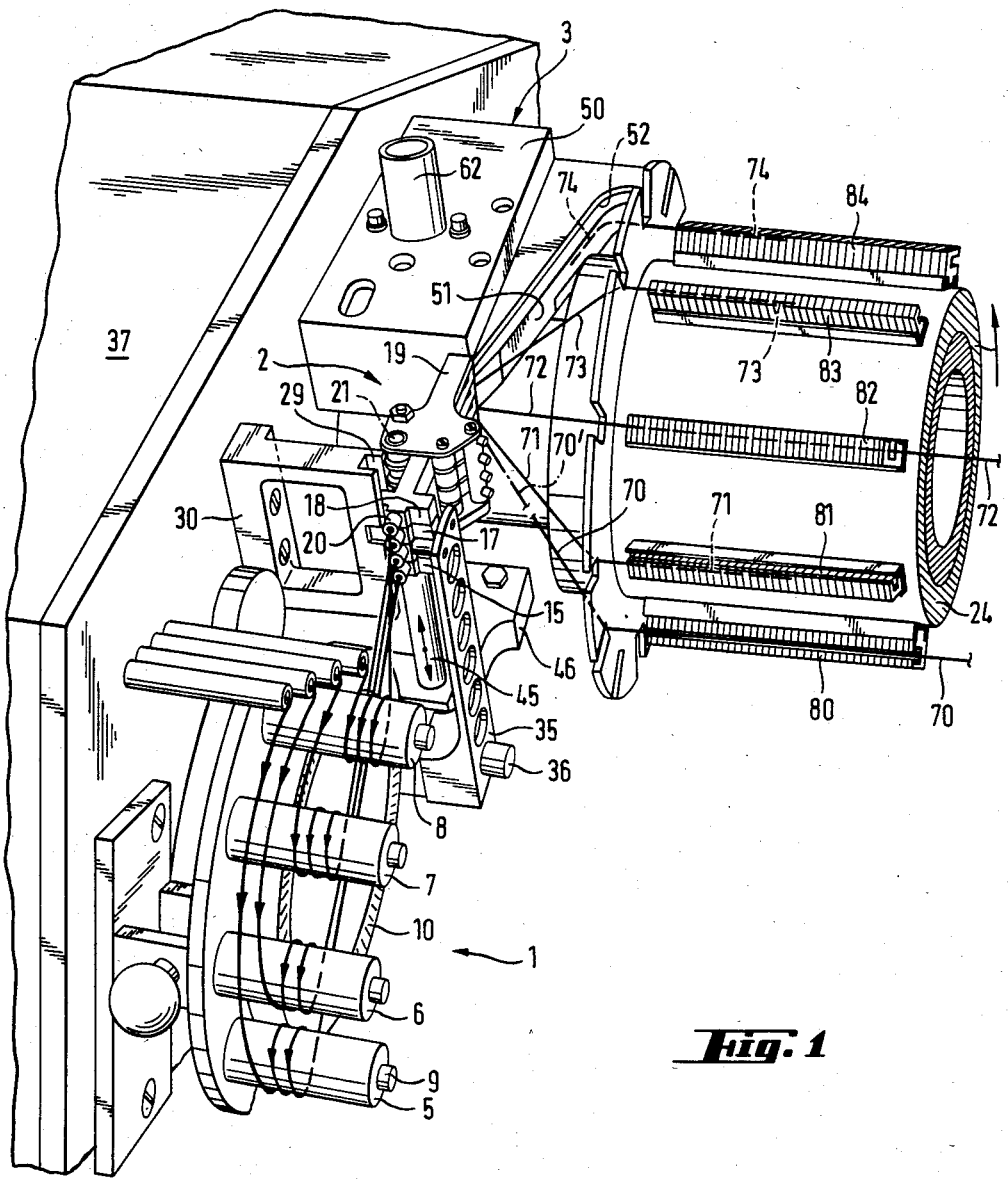
FIG. 1 illustrates a perspective view of a weft thread preparation device according to the invention.

Referring to FIG. 1, the weft thread preparation device includes a weft measuring means 1, a severing means 2 and a weft insertion or picking means 3.

The measuring means 1 includes four drums 5,6,7,8 which are freely rotatable on spindles 9 and which are driven by a continuously rotating friction disk 10. In operation, the measure means 1 serves to continuously measure and convey a plurality of weft threads.

Figure 2:
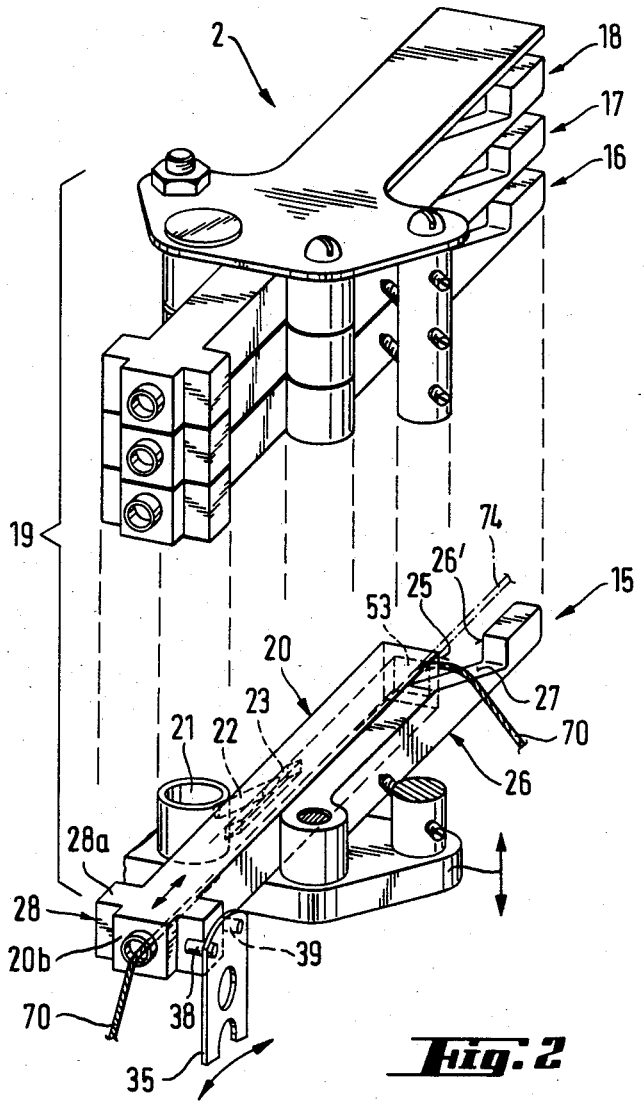
FIG. 2 illustrates an exploded perspective view of a severing means constructed in accordance with the invention.

Referring to FIGS. 1 and 2, the severing means 2 includes four shears 15,16,17,18 which are combined to form a unit 19. Each shear 15–18 is constructed in the same manner. Hence, reference will be made to the lowermost shear 15 for the details of construction.

As shown in FIG. 2, the lowermost shear 15 has a blowing tube 20 for receiving a weft-conveying air stream to pneumatically convey a weft thread 70 therethrough. As indicated, the four blowing tubes 20 are supplied continuously with compressed air through a common duct 21. This compressed air flows from the duct 21 into a duct 22 which is at an inclination to the blowing tube 20 and passes by way of a longitudinal slot 23 in a wall of the tube 20. The weft 70 is entrained by the blowing air and is supplied to a rotor 24 as described below.

The blowing tube 20 also has a cutting edge 25 at the exit end or aperture of the tube 20 which cooperates with a stationary cutting element 26. As indicated, the cutting element 26 is formed with a lateral recess 27 to permit egress of the weft 70. In addition, the cutting element 26 has a cutting edge 26' which cooperates with the cutting edge 25 on the tube 20 for severing of the weft thread 70.

Referring to FIG. 1, each of the blowing tubes 20 of the severing means 2 has a collar 28 at one end **20*b* with one side 28*a* of which is slidably mounted to reciprocate in a guideway 29 of a guide frame 30 secured to a side wall of a gear box 37** of a weaving machine (not shown).

Figure 3:
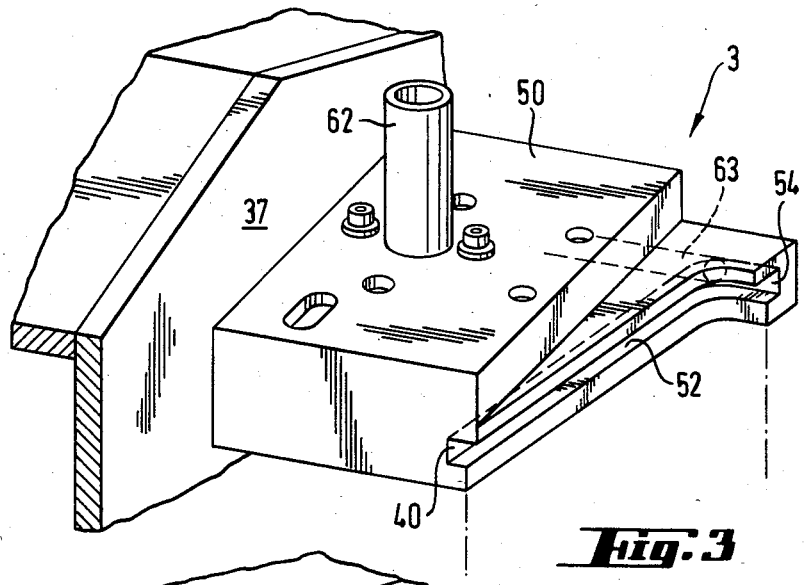
FIG. 3 illustrates a perspective view of a weft insertion means constructed in accordance with the invention.

Referring to FIGS. 1 and 3, the weft insertion means 3 includes a casing 50 which is rigidly secured to the gear box 37 of the weaving machine. In addition, the casing 50 houses a guide duct 52 which is open on one side near the weaving rotor 24 and which extends from an entry 40 adjacent the severing means 2 to an exit 54 disposed adjacent to the weaving rotor 24. As indicated in FIG. 3, a blowing duct 63 extends into the guide duct 52 near the exit end 54 and in parallel relation to a picking comb 80,81,82,83,84 on the weaving rotor 24 in order to blow a stream of air into the guide duct 52 to pick a weft thread therein into the respective picking comb 80–84.

Referring to FIG. 1, the weft insertion means 3 also has a closure member 51 on one side of the guide duct 52 in order to retain a weft thread therein prior to insertion into a picking comb 80–84.

Referring to FIG. 1, a control means is provided for selectively moving the shears 15–18 in sequence to position a blow tube 20 of a respective shear 15–18 in alignment with the entry 40 of the guide duct 52 in order to convey a weft thread 70,71,72,73 thereto. This control means includes a rod 45 which carries the severing means 2 and which is vertically reciprocated by a lever 46. The lever 46 is, in turn, secured to a shaft (not shown) which extends into the gear box 37 for guidance therein by way of a lever and a follower on a cam (not shown). The operative part of the cam is such that the rod 45 so lowers the severing means 2 that the shears 15–18 are positioned in that order before the entry 40 of the guide duct 52. Thereafter, the rod 46 raises the severing means 2 back to the initial position so that the lowermost shear 15 is again disposed before the entry 40.

In addition, a control means is provided for selectively actuating the shears 15–18 in sequence to sever a weft thread in response to picking of the weft thread across a picking comb. This control means employs a cutting lever 35 to produce a cutting or advancing movement of each blowing tube 20. As indicated in FIG. 1, the lever 35 is mounted on a spindle 36 which extends into the gear box 37 where the spindle 36 is guided by way of a lever and a cam follower on a cam (not shown). As indicated in FIG. 2, the upper end of the lever 35 carries two pins 38,39 which are disposed at the height of the entry 40 of the weft insertion means 3. These pins 38,39 extend about the collar 28 of whichever blowing tube 20 is disposed before the entry 40. When the control means is actuated, the lever 35 pivots to the right as viewed in FIG. 2 to cause the blowing tube 20 to move to the right relative to the stationary cutting element 26. This permits the cutting edges 25,26' to sever the weft thread 70.

Figure 4:
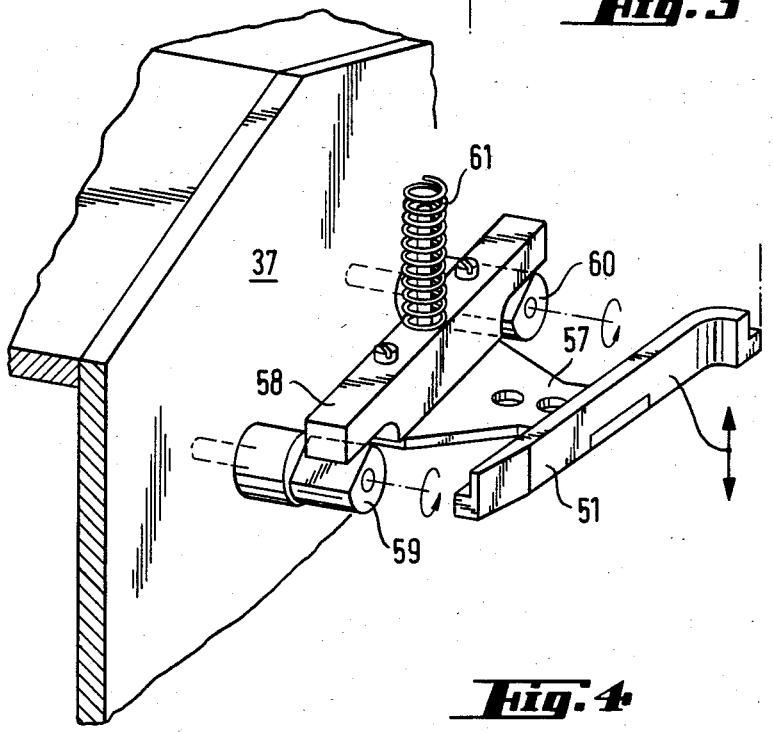
FIG. 4 illustrates various internal components of the weft insertion means of FIG. 3.

A control means is also provided for moving the closure member 51 from the guide duct 52 in response to insertion of a weft thread into a picking comb 80–84 adjacent the guide duct 52 so as to permit a subsequent lateral movement of the weft thread from the guide duct 52. As shown in FIG. 4, with the closure member 51 in the form of a plate, the control means includes an arm 57 which is secured to the plate 51 and which is carried by a yoke 58 which is vertically reciprocated intermittently by two cams 59,60. When the yoke 58 rises, the plate 51 rises to the guide duct 52, whereas when the yoke 58 descends, the plate 51 opens the duct 52 on the one side. A restoring force for the yoke 58 is provided by a compression spring 61 which is disposed in a bush 62 on the casing 50. The spindles of the cams 59, 60 extend through the wall of the gear box 37 and are driven by way of suitable parts therein.

During operation, the control means serves to alternately open and close the guide duct 52 by moving the plate 51 towards and away from the guide duct 52, i.e. between one position closing the guide duct 52 and a second position opening the guide duct 52.

The operation of the weft thread preparation device is as follows:

First, it is assumed that the weaving machine is in operation and that the weaving rotor 24 is rotating in the direction indicated by the arrow in FIG. 1. The drums 5–8 continuously and simultaneously take up four weft threads 70–73 from fixedly mounted supply bobbins (not shown). The weft threads leaving the drums pass through the blowing tube 20 of the particular shear 15–18 concerned. Initially, the rod 45 has fully raised the severing means 2 so that the lowermost shear 15 is disposed before the entry 40 of the weft insertion means 3.

Referring to FIG. 2, with air being continuously supplied through the common duct 21, air is blown into the tube 20 of the shear 15 so as to draw in and convey the weft thread 70 through the exit end 53 of the tube 20. At the same time, the weft thread 70 is blown into the guide duct 52 and subsequently passed through the exit end 54 of the guide duct 52 into the first picking comb 80 on the weaving rotor 24. As the rotor 24 continues to rotate, the control means for the closure member 51 causes the closure member 51 to lower away from the side of the guide duct 52. This permits the weft thread 70 to move laterally out of the guide duct 52 while being picked through the comb 80 until moving into a position as indicated in FIG. 5*a*. During this time, the weft thread 70 moves into the recess 27 in the cutting element 26 as indicated in FIG. 2.

The control means for the severing means 2 next moves the shears 15–18 in sequence to position the next blowing tube 20 of the shear 16 at the entry 40 to the guide duct 52. At the same time, the control means for the closure member 51 moves the closure member 51 into the closed position adjacent the guide duct 52 so that the next weft thread 71 can be picked into the next picking comb 81. This sequence continues so that the four weft threads 70–73 have been delivered to the respective picking combs 80–83 as indicated in FIG. 5*a*. In this respect, the weft threads are staggered in the corresponding picking combs 80–83 with an offset in each case of about ¼ of cloth width in each particular shed.

As the foremost or leading weft thread 70 aporoaches the shed apex due to the rotation of the weaving rotor 24, picking over the full width of the shed becomes complete. Hence, the control means for selectively actuating the shears 15–18 is actuated to sever the weft thread 70. To this end, the cutting lever 35 moves forwardly, as viewed in FIG. 2, so that the associated blowing tube of the shear 15 moves across the cutting element 26 so that the weft thread 70 is severed. The weft thread remaining in the tube 20 is retained by the airstream therein and is blown as the next weft thread 74 into the guide duct 52 which the plate 51 has meanwhile closed. Thereafter, boosted by the airstream from the duct 63, the weft thread 74 is blown into the next picking comb 84 on the rotor 24 which has arrived in the meantime as indicated in FIG. 5*a*. Consequently, the weft thread is not stopped in movement from the measuring drum 5 to the weaving rotor 24 but is moved continuously and at a constant speed.

Of note, the released end of the weft thread 70 is engaged by an element (not shown) immediately prior to cutting by the cutting element 26 so that the weft thread is braked to a standstill. A beating-up comb (not shown) which follows the picking comb 80 then beats the weft thread 70 up into the cloth (not shown).

Referring to FIG. 5*b*, after insertion of the weft thread 74 into the picking comb 84, the rod 45 lowers the severing means 2 by one program step so that the blowing tube of the shear 16 which guides the weft thread 71 is now before the guide duct entry 40. Thereafter, the weft thread 75 is inserted into the next picking comb 85. Thereafter, the severing means 2 is lowered in two consecutive steps and the wefts 72,73 are inserted. Thereafter, the rod 45 raises the severing means 2 through four steps so that the means 2 is in the initial position with the lowermost shear 15 before the entry 40. The sequence of steps is then repeated.

The invention thus provides a weft thread preparation device which is of relatively simply construction and low cost. Further, the invention provides a device by which a plurality of weft threads can be sequentially picked into a sequence of picking combs on a weaving rotor in a continuous manner.

What is claimed is:

1. A weft thread preparation device for a superposed shed type weaving machine having a weaving rotor with a plurality of weft picking combs and beating-up combs, said device comprising a weft measuring means for continuously measuring and conveying a plurality of weft threads;

a severing means having a plurality of shears for severing the respective weft threads, each shear having a blowing tube for receiving a weft-conveying air stream to pneumatically convey a weft thread therethrough and a cutting element for severing a weft thread extending from said blowing tube;

a weft insertion means having a guide duct extending from a selected one of said shears to the weaving rotor to guide a weft thread therethrough and a closure member on one side of said guide duct to retain a weft thread therein;

a first control means for selectively moving said shears in programmed sequence to position a blowing tube of a respective shear in alignment with said guide duct to convey a weft thread thereto;

a second control means for moving said closure member from said guide duct in response to insertion of a weft thread into a picking comb adjacent said guide duct to permit subsequent lateral movement of the weft thread from said guide duct; and a third control means for selectively actuating said shears in programmed sequence to sever a weft thread therein in response to picking of the weft thread across a picking comb.

2. A weft thread preparation device as set forth in claim 1 wherein said weft insertion means includes a blowing duct extending into said guide duct near an exit end of said guide duct and in parallel relation to a picking comb for blowing a stream of air into said guide duct to pick a weft thread therein into the picking comb.

3. A weft thread preparation device as set forth in claim 2 wherein said weft insertion means includes a casing housing said guide duct and said second control means, and wherein said closure member is a plate extending longitudinally of an open side of said guide duct for movement between one position closing said guide duct and a second position opening said guide duct.

4. A weft thread preparation device as set forth in claim 1 wherein said weft insertion means includes a casing housing said guide duct and said second control means, and wherein said closure member is a plate extending longitudinally of an open side of said guide duct for movement between one position closing said guide duct and a second position opening said guide duct.

5. In combination, a weaving rotor having at least one picking comb thereon;

a weft measuring means for measuring and conveying a weft thread;

a severing means having a shear for severing a weft thread, said shear including a blowing tube for receiving an conveying a weft thread from said measuring means and a cutting element for severing a weft thread extending from said tube;

a weft insertion means having a guide duct for guiding a weft thread from said shear to said picking comb and a closure member for retaining the weft thread in said guide duct;

a first control means for moving said closure member from said guide duct in response to insertion of a weft thread into said picking comb to permit subsequent lateral movement of the weft thread from said guide duct; and a second control means for selectively actuating said shear to sever a weft thread in response to picking of the weft thread across said picking comb.

6. The combination as set forth in claim 5 wherein said closure member is a plate extending longitudinally along one side of said guide duct and said first control means is connected to said plate to move said plate towards and away from said guide duct.

* * * * *